US008956693B2

(12) United States Patent
Hovinen

(10) Patent No.: US 8,956,693 B2
(45) Date of Patent: Feb. 17, 2015

(54) SURFACE TREATMENT DEVICE AND METHOD

(75) Inventor: Anssi Hovinen, Espoo (FI)

(73) Assignee: Beneq Oy, Vantaa (FI)

( * ) Notice: Subject to any disclaimer, the term of this patent is extended or adjusted under 35 U.S.C. 154(b) by 0 days.

(21) Appl. No.: 13/879,663

(22) PCT Filed: Oct. 20, 2011

(86) PCT No.: PCT/FI2011/050921

§ 371 (c)(1),
(2), (4) Date: Sep. 25, 2013

(87) PCT Pub. No.: WO2012/052622

PCT Pub. Date: Apr. 26, 2012

(65) Prior Publication Data

US 2014/0017413 A1 Jan. 16, 2014

(30) Foreign Application Priority Data

Oct. 21, 2010 (FI) ..... 20106088

(51) Int. Cl.

| | |
|---|---|
| ***B05D 1/02*** | (2006.01) |
| ***B05C 5/00*** | (2006.01) |
| ***B05B 13/02*** | (2006.01) |
| ***B05B 15/04*** | (2006.01) |
| ***C23C 24/04*** | (2006.01) |
| *B05B 7/02* | (2006.01) |

(52) U.S. Cl.

CPC ..... *B05C 5/001* (2013.01); *B05B 13/02* (2013.01); *B05B 15/0431* (2013.01); *C23C 24/04* (2013.01); *B05D 1/02* (2013.01); *B05B 7/02* (2013.01)

USPC ..... 427/226; 427/227; 118/300; 118/324

(58) Field of Classification Search

USPC ..... 427/226–229; 118/300, 324

See application file for complete search history.

(56) References Cited

U.S. PATENT DOCUMENTS

| | | | | |
|---|---|---|---|---|
| 3,689,304 | A * | 9/1972 | Bamford | 427/314 |
| 4,655,810 | A * | 4/1987 | Van Cauter et al. | 65/60.4 |
| 4,728,353 | A | 3/1988 | Thomas et al. | |
| 5,522,911 | A * | 6/1996 | Terneu et al. | 65/27 |
| 5,882,368 | A | 3/1999 | Falcony-Guajardo et al. | |
| 2004/0231758 | A1 * | 11/2004 | Hampden-Smith et al. | 148/537 |

FOREIGN PATENT DOCUMENTS

| | | | |
|---|---|---|---|
| FI | 20080468 | A | 4/2010 |
| WO | WO2007110482 | A1 | 10/2007 |
| WO | WO2008046969 | A1 | 4/2008 |

* cited by examiner

*Primary Examiner* — Frederick Parker

(74) *Attorney, Agent, or Firm* — Marsh Fischmann & Breyfogle LLP; Daniel J. Sherwinter

(57) ABSTRACT

A surface treatment device that ejects a combination of precursor substances as a directed flow of surface treatment particles. Planar objects are conveyed along a defined plane through the particle flow, a region on the surface of the planar object that the particle flow hits forming a region of direct impact. The device comprises directing means for directing the particle flow to travel along the surface of the planar object in an extended impact region outside the region of direct impact; and flow control means for controlling the extent of the extended impact region which may include a vortex flow. The exposure of the treated surface with the particle flow increases and the probability of the desired surface treatment processes to take place increases.

20 Claims, 5 Drawing Sheets

SURFACE TREATMENT DEVICE AND METHOD

FIELD OF THE INVENTION

The present invention relates to a surface treatment device, and to a surface treatment method according to preambles of the independent claims.

BACKGROUND ART

Surface treatment refers here to a layering process where a surface layer of a substrate is modified by allowing particles to diffuse in the substrate matrix, or where particles are deposited on the surface such that a coating is produced on the substrate. Particles used for this kind of surface treatment are typically very small, the size distribution ranging from 10 to 100 nm. Particles of this size are generally referred to as nanoparticles. Nanoparticles are generated in a particle synthesis process where precursor chemicals are exposed to a thermal reactor. In the intense heat of the thermal reactor they undergo specific thermochemical and physical reactions that lead to synthesis of desired particles.

In industrial applications, the particle synthesis process typically incorporates a source element that applies a nozzle for ejecting a combination of precursor substances for surface treatment particles, and a thermal reactor for transforming the combination of precursor substances to a directed particle flow. Typically the thermal reactor is a turbulent hydrogen-oxygen flame into which the nozzle outlet channels from one or more nozzles feed materials, either mixed together or through separate outlets.

Conventionally the surface treatment implementations have been strictly focusing to direct impact areas where the flow of nanoparticles is directed against the treated surface rectilinearly. Particle flow effects outside direct impact areas have been considered as residue and various measures have been applied to effectively eliminate these effects from industrial surface treatment processes. This conventional approach is, however quite ineffective, since a considerable amount of particles does actually not end up in the treated surface, but is removed with carrier gases away from the process atmosphere. This manifests as poor yield and added efforts for cleaning the contaminated process atmosphere.

SUMMARY

An object of the present invention is thus to provide a method and an apparatus for implementing the method so as to overcome, or at least alleviate one or more of the above problems. The object of the invention is achieved by a surface treatment device and surface treatment method, which are characterized by what is stated in the independent claims. The preferred embodiments of the invention are disclosed in the dependent claims.

The invention is based on including in the surface treatment procedure flow control means that direct the particle flow to controllably progress from the point of direct impact along the treated surface, and deflecting means that deflect the particle flow from the surface of the planar object after the predefined distance.

An advantage of the invention is that the exposure of the treated surface with the particle flow increases and the probability of the desired surface treatment processes to take place increases. The yield from the selected precursor components improves and less precursor substances remain to be cleaned from the process atmosphere.

BRIEF DESCRIPTION OF THE DRAWINGS

In the following, embodiments will be described in greater detail with reference to accompanying drawings, in which.

DETAILED DESCRIPTION OF SOME EMBODIMENTS

The following embodiments are exemplary. Although the specification may refer to "an", "one", or "some" embodiment(s), this does not necessarily mean that each such reference is to the same embodiment(s), or that the feature only applies to a single embodiment. Single features of different embodiments may also be combined to provide further embodiments.

In the following, features of the invention will be described with a simple example of a device architecture in which various embodiments of the invention may be implemented. Only elements relevant for illustrating the embodiments are described in detail. Various implementations of surface treatment methods and devices comprise elements that are generally known to a person skilled in the art and may not be specifically described herein. Configurations of the surface treatment device may be described in operational situations where the defined device elements are mutually adjusted to provide defined flow conditions. Such adjustments of the system elements are apparent from the description and can be made through simple tests and trials by a person skilled in the art.

A surface treatment device refers here to an apparatus that generates nanoparticles and directs them to a surface to be treated. According to an embodiment of the invention, the surface treatment device comprises a source element 100 that includes a nozzle for ejecting a combination of precursor substances for surface treatment particles, and a thermal reactor for transforming the combination of precursor substances to a particle flow. The nozzle represents here an element that generates a directed flow of precursor substances and leads them into a thermal reactor. The thermal reactor represents here an element that provides a local distribution of heat such that objects traversing locations of that distribution are exposed to the heat accordingly.

Figure 1:
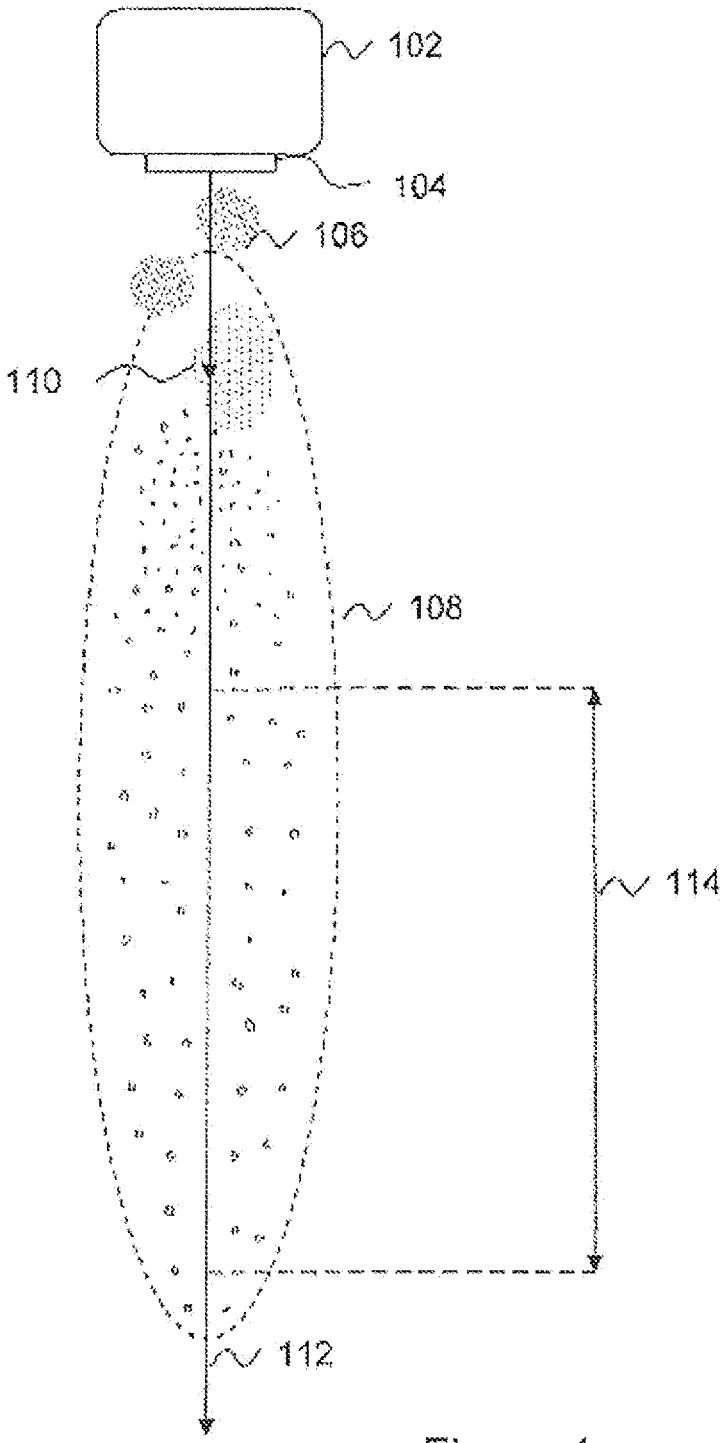
FIG. 1 illustrates a source element of an embodiment of a surface treatment device.

In the following, an embodiment applying at least one liquid precursor substance is used as an example. However, precursor substances may be ejected in liquid, vaporous or gaseous form without deviating from the scope of protection. When one or more liquid precursors are used, the nozzle may advantageously output a premixed liquid mixture as a jet of droplets and expose this jet of droplets to a thermal reactor that transforms the jet of droplets into a directed flow of nanoparticles. FIG. 1 illustrates an embodiment where the thermal reactor is implemented as a hydrogen-oxygen flame, but other forms of thermal reactor arrangements may; however, be applied without deviating from the scope of protection. For example, thermal reactor may be implemented using a high power laser beam or a set of high power laser beams.

In FIG. 1, the source element 100 comprises a liquid source 102, and a nozzle 104. The liquid source 102 refers here to an input of liquid feed-stock that comprises at least one precursor substance for nanoparticles to be produced for the surface treatment. The liquid source 102 leads to the nozzle 104 that is configured to atomize the exiting liquid into a jet of droplets. A droplet refers here to a very small sized drop of mixture, the diameter d of a droplet being of the order of micrometers or less. Atomization may be implemented in the nozzle 104 with, for example, a two-fluid atomizer where gas is used to break up the liquid feed into droplets. The liquid droplet and the atomizing gas form an aerosol that sprays out of the nozzle. Other methods of atomization may naturally be applied without deviating from the scope of protection.

The nozzle 104 is also configured to combine the jet of droplets with a flow of combustible substance. A combustible substance refers here to a substance that may be ignited in defined circumstances and after ignition burns in an exothermal reaction. The combustible substance is typically a combustible gas, which in a gas flow is directed towards the jet of droplets. The combustible gas may be used as an atomizing gas of the two-fluid atomizer, or the nozzle 104 may comprise one or more separate outlets for atomizing gases and combustible gases and any other gases necessary for the flame production. In combining the jet of droplets and the combustible substance are mixed or otherwise brought into such vicinity of each other that they progress together, and after ignition of the combustible material the jet of droplets is exposed to the heat from the burning combustible material.

The nozzle 104 is further configured to ignite the exiting combustible substance. Ignition typically takes places when the combustible substance that flows out of the opening of nozzle gets exposed to the heat of an existing external flame of the combustible substance. Other means of ignition may, however, be applied without deviating from the scope of protection. The rate of flow of the combustible substance is advantageously adjusted such that the flame does not progress to the nozzle 104 or even to the immediate vicinity of the opening of the nozzle 104.

The nozzle 104 is configured to spray the jet of droplets 106 in an initial direction 110. The direction of the jet 110 refers to the average direction of propagation of the jet and the initial direction corresponds with an average direction of droplets that exit the opening of the nozzle 104. Depending on the configuration of the nozzle 104, the spray may have a defined directional pattern based on which the initial direction can typically be determined. For example, in case the droplets are sprayed as an aerosol with pressure through a circular opening, the initial direction corresponds with the direction from the center of the opening of the nozzle to the direction of the pressure field. In case the droplets are sprayed with pressure through a line-shaped opening, the initial direction corresponds with the direction from the center of the line opening of the nozzle to the direction of the pressure field.

In the heat of the flame the droplets that comprise at least one precursor material substance for nanoparticles evaporate, react, nucleate, condense, coagulate and agglomerate in a manner well known to a person skilled in the art. These processes transform the jet of droplets into a high-temperature flow of nanoparticles 108, also called as a flame. The direction of the particle flow 112 refers to the average direction of propagation of the particle flow and corresponds to the direction of the average velocity vector of the particle flow. The average velocity vector of the particle flow 112 refers to an average of velocity vectors of particles in the particle flow 112. It is evident that the direction of the average velocity vector corresponds substantially with the initial direction of the jet of droplets 110 and the speed of the average velocity vector corresponds substantially with the pressure used in spraying the jet of droplets. The particle flow 108 is typically turbulent.

FIG. 1 illustrates a region 114 of the particle flow considered as a preferable deposition and collection zone for nanoparticles. When a planar object needs to be treated, it has been conventionally exposed perpendicularly to the particle flow in this zone. The particles of the flow adhere to the planar object and implement the desired treatment, e.g. form a desired coating thereon or modify the surface in a desired manner. In the present invention the regional exposure of the particles with the treated surface is, however, extended, which increases the probability of the particles to adhere to the surface.

Figure 2:
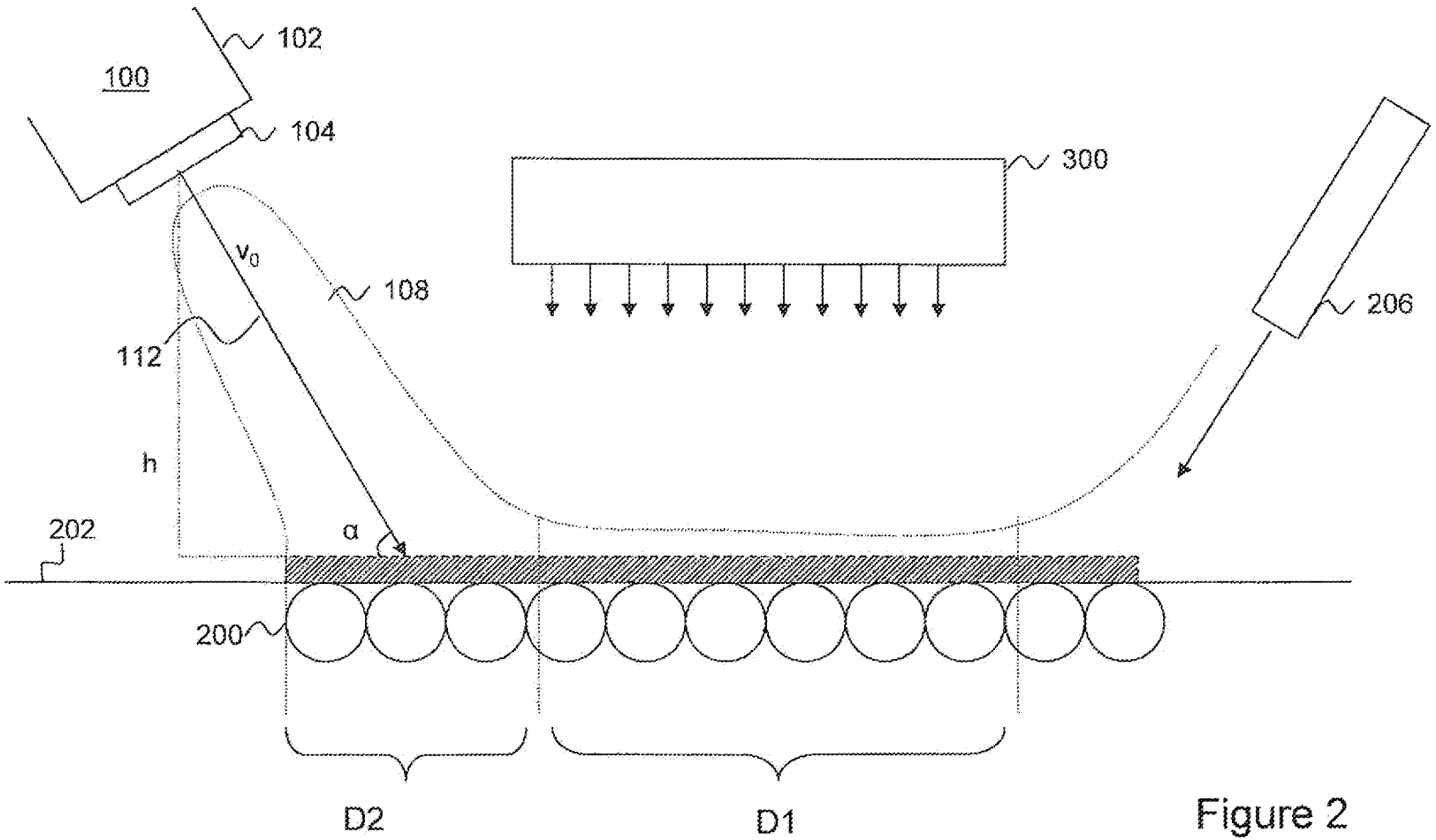
FIG. 2 illustrates an embodiment for a surface treatment device.

FIG. 2 shows a block diagram of an embodiment of a surface treatment device. The liquid source 102, the nozzle 104, the particle flow 108, the initial direction 110 and the direction of the particle flow 112 correspond with the elements of FIG. 1. The surface treatment device comprises also a conveyor element 200 that provides a support mechanism for planar objects, and a moving mechanism for transporting the supported planar objects along a defined plane 202 through the flow of particles 108. The conveyor element may either be configured to move the planar object in a defined plane in respect of the nozzle, move the nozzle in a defined plane in respect of the planar object, or move both the nozzle and the planar object in respect of each other.

In the embodiment of FIG. 2 the support mechanism is implemented as a supporting surface, a roll conveyor. The defined plane 202 corresponds here with the level formed by the top surfaces of successive rolls. This level acts as the supporting surface for the planar objects. The roll conveyor comprises also a rotating mechanism that rotates the rolls during operation and thereby moves a planar object that rests on them in the level of the top surfaces of the rolls to the direction of the rotation. Other types of support mechanisms and conveyor elements may be applied without deviating from the scope of protection.

The surface treatment device of the embodiment according to the invention as illustrated in FIG. 2 comprises directing means 300 for directing the particle flow to travel along the surface of the planar object. The travel may extend to an extended impact region D1 outside the region of direct impact D2. In addition, the surface treatment device comprises flow control means 206 for controlling the extent of the extended impact region. Accordingly, during operation the directing means direct the particle flow to travel along the surface of the planar object. While travelling along the surface the flow dynamics of the particle flow facilitates such interaction between the particles of the particle flow and the surface that surface treatment reactions may occur between them. The surface treatment device is optimally adjusted so that the distance travelled in such interaction covers the whole of the extended impact region. On the other hand, the flow control means of the surface treatment device ensure that interaction that facilitates the surface treatment reactions ends controllably.

FIG. 2 illustrates an exemplary surface treatment device that is configured to create a direct impact region D2 and an extended impact region D1. The direct impact region D2 corresponds here with a region on the surface of the planar object that the particle flow 108 during operation of the surface treatment device hits substantially in the direction of its average velocity. Thus in the direct impact region D2 interactions between the surface of the planar object and particles of the particle flow mainly include first impacts of the particles on the surface. The extended impact region D1 corresponds with a region in which the particle flow 108 progresses substantially along the surface of the conveyed planar object. The particle flow 108 after the impact with the surface of the planar object may be laminar or turbulent.

The directing means may comprise explicit flow directing elements, as well as elements that control characteristics of the flow itself. In the present embodiment, flow conditions across regions D1 and D2 may be controlled by mutual adjustments of the nozzle angle α, the flow exit velocity at the nozzle $v_o$, and nozzle height h. For example, the directing means may be configured to adjust the velocity of the particle flow and the mutual positioning of the nozzle and the conveyor element such that during operation of the device the particle flow hits the surface of the planar object in the direction of an angle α. This angle represents the angle between the direction of propagation, i.e. the direction of the average velocity of the particle flow 112 and the surface of the treated planar object, but the angle α may also be determined from the device configuration in a straightforward manner with orientations of the nozzle 104 and the supporting surface 202. The surface of the treated planar object is parallel to the defined plane 202, here the supporting surface, and the orientation of the nozzle 104 indicates the direction of the jet 110, which again corresponds with the direction of the particle flow 112. The angle α may thus be determined on the basis of these easily measurable physical elements. The region on the surface of the planar object that the particle flow hits in the direction of an angle α is the direct impact region D2.

In the direct impact region D2, part of the particles that do not adhere immediately with the surface may bounce and drift away from the surface, and part of this particle flow may continue to progress along the surface of the planar object along the defined plane 202. The region on the surface of the planar object in which the particles are controllably directed to travel form an extended impact region D1. In this extended impact region D1 the direction of the particle flow is no more aligned to the average velocity vector of the arriving particle flow but the particle flow traverses substantially along the treated surface under influence of diffusion, thermophoresis, or the like. The particle flow thus remains in the vicinity of the surface of the planar object such that particles of the particle flow may continue to deposit on the surface or diffuse into it.

However, the extended impact region D1 should preferably not extend beyond the preferable deposition and collection zone of the particle flow. One possible limitation comes from the fact that hot, nanosized particles have a tendency to agglomerate to clusters. The size of a cluster typically has a limit after which the surface treatment process is no longer optimal. It is therefore essential that flow conditions in the path of the particle flow on the treated surface can be controlled such that the extent of the extended impact region can be kept within a preferred deposition and collection zone. The surface treatment device of FIG. 2 thus comprises deflecting means 206 for deflecting the particle flow 108 from the surface of the planar object after the extended impact region D1. The deflecting means direct particles away from the surface of the treated surface and end the exposure of the surface to the particle flow preferably after a point in which surface treatment reactions are no longer considered optimal for the end result. For example in the case of FIG. 2, the particle flow is deflected at a desired distance D1 from the direct impact region D2.

In the embodiment of FIG. 2 the flow control means are implemented by explicit deflection means 206 that deflect the particle flow from the surface of the planar object outside the region of direct impact but before a region where natural flow separation would occur. Natural flow separation occurs in a region where total drag force has slowed the flow velocity enough. The drag force effect has its origins on boundary layer physics for shear stress, and it is well documented in literature. One consequence of the drag effect is that a moving fluid loses kinetic energy, which means that the particle flow slows down when it traverses along the surface of the planar object. At some distance boundary layer separation may occur, and this together with buoyant force turns the particle flow away from the treated surface, and eventually rips it off. A distance where such natural deflection happens depends on the process parameters but it is easily determined for specific configurations by a person skilled in the art.

In the embodiment of FIG. 2 the natural deflection distance would depend on the average velocity of the particle flow; meaning the angle α in combination with the speed of the particle flow traversing on the treated surface. The point of natural deflection is also dependent on the temperature of the surface. In one implementation of FIG. 2, the nozzle angle α and the height h are adjusted such that for a given flow velocity $v_o$ at nozzle exit, the particle flow hits the surface providing unidirectional velocity field across the direct impact region D2. The extended impact region D1 is limited to remain below the natural deflection distance by means of a blower 206. On the other hand, a stepwise rise in surface temperature along region D1 would promote flow separation. Another exemplary implementation of flow control means could thus utilize surface temperature modification by means of local laser excitation to promote flow separation at preferred distance D1. Other mechanisms for deflecting the particle flow from the surface may be applied without deviating from the scope of protection.

As discussed earlier, the optimal length of the deposition and collection zone that defines the optimal extent of the extended impact region is an application-specific parameter that a person skilled in the art can simply define through testing. In conditions when hydrogen/oxygen flame process is used for vertical flame deposition the nozzle distance from treated surface is typically in the order of 100 mm, particle velocity is between 100 to 300 m/s, and maximum flame temperature is in the order of 2000 degrees Celsius. The first deposition zone, i.e. the direct impact region D2 extends to some 20 mm from the point below the nozzle opening. Without any explicit flow control means, flame ends may expand to around 200 mm to either side of the direct impact region. The extended impact region D1 is thus optimally limited to regions where distances travelled by the particle flow from the direct impact region are in the order of 100-200 mm.

On many cases it is useful to tilt the nozzle such that the flame is not vertical. In the example of FIG. 2, the particle flow hits the surface in an angle α. Typically when the nozzle is tilted, the angle α at some point reaches a critical value where the flow turns unidirectional, or travels along the surface of the planar object forming a one sided deposition area on the surface. In such condition, there is no immediate region of direct impact. As part of direction means, the angle α may be further reduced from the critical value to promote even longer travelled distances for the particle flow in the extended impact region D1. In some cases the initial direction of the particle flow may be almost aligned with the treated surface already within the direct impact region D2, i.e. the angle α may vary in the range of 1 . . . 90 degrees. When the angle α is very small, for example varies in the range of 1 . . . 5 degrees, most of the deposition occurs already across region D2. For example, in a process where a glass sheet was colored brown with copper using a very small angled flow of precursor materials and hydrogen-oxygen flame, the impact region could extend to lengths of the order of 150 mm from the first point of direct impact and provided good surface treatment results. This ability to control the length of the region D1 or D2 is very important in optimization of overall collection efficiency of material to the treated surface.

Surface treatment devices according to FIG. 2 may contain separate nozzles 104 with separate flames 108. The nozzles may also be arranged such that they form a uniform line of flame without gaps between nozzles. The nozzle itself may be constructed such that it forms a linear flame.

Vertical nozzle arrangement ($\alpha$=90 degrees) provides typical conditions for liquid flame deposition, where a stagnant point occurs directly under the nozzle, and flow diverges to opposite horizontal directions around stagnant point. It is obvious that when the angle $\alpha$ is decreased from 90 degrees, the stagnant point moves accordingly. With a defined combination of nozzle height, angle, flow velocity and temperature a vortex may appear in the particle flow before the direct impact region D2. With linear flame arrangement this vortex is tubular in shape and easily controlled. This vortex may be used as further collection means that act as a reservoir for particles that would otherwise escape the surface treatment processes. Use of the vortex before the direct impact region D2 increases the probability of deposition or diffusion of trapped particles. By adjusting deflection means 206 in combination with the nozzle arrangement, a vortex may be formed to the extended impact region D1. In such a case, the particle flow does not travel linearly through an elongated region in the surface but circulates in a confined extended impact region. The increased interaction between the particle flow and the surface significantly increase the probability of the surface treatment reactions. Particle accumulation occurs within the vortex, and local temperature is also higher there. These together favor particle adherence to surface below the vortex thus increasing overall deposition efficiency of the process.

Figure 3:
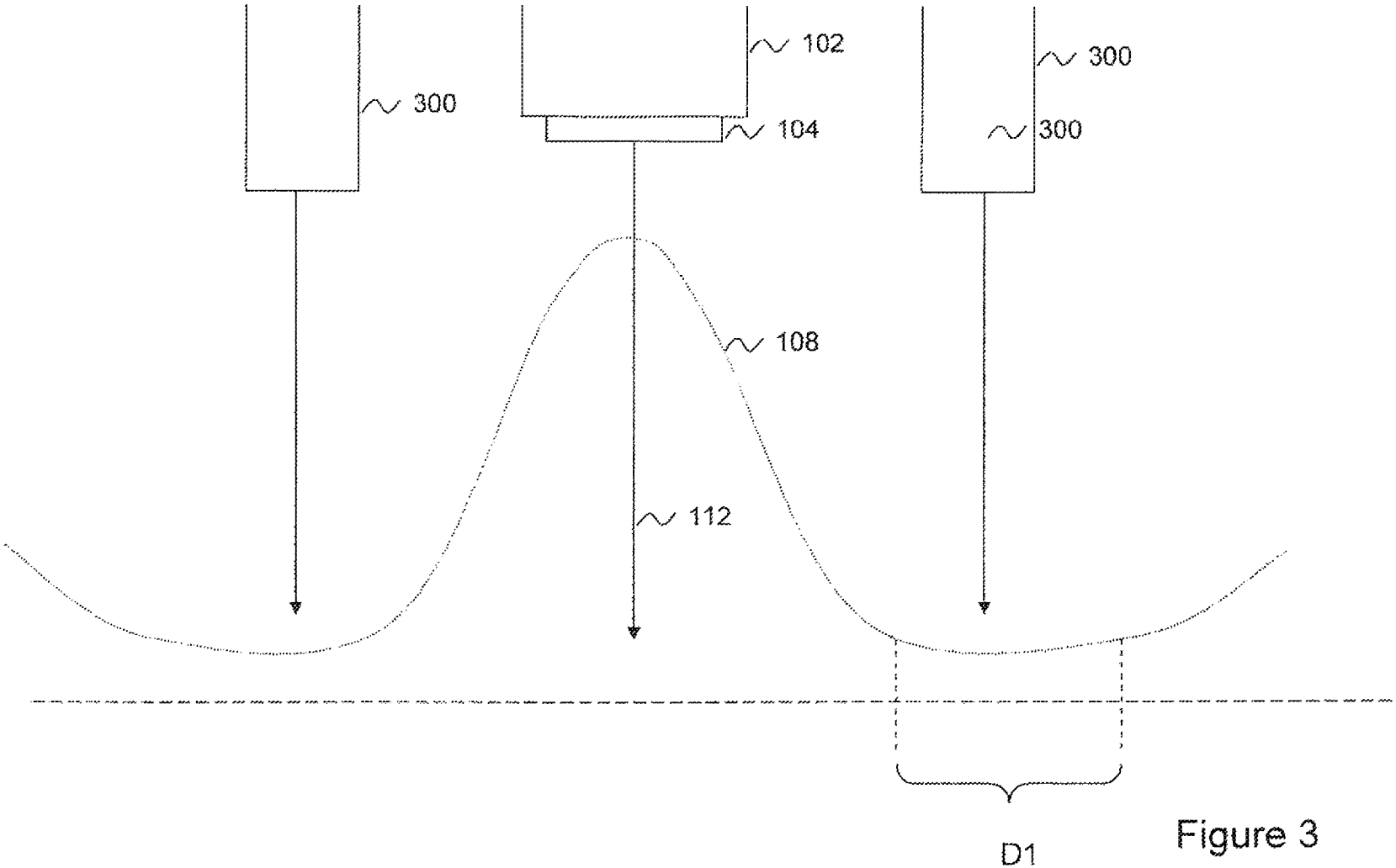
FIG. 3 illustrates another implementation of flow control means for a surface treatment device

FIG. 3 illustrates another example of directing means of a surface treatment device. This configuration comprises a blower 300 that is arranged to blow inert gas towards the main flow travelling along the treated surface. The blowers 300 provide controlled means to feed nitrogen or other fluid to regions from where the particle flow drags material along. If the blower feed is higher than needed to compensate the drag effect, positive pressure that shields the main flow builds up. The pressure of the gas from the blower 300 may be adjusted to push the flow 108 after its direct impact with the treated surface towards the surface and direct the particle flow to progress along the surface 202. Preferentially, the blower gas is heated to avoid unnecessary cooling of the particle flow within the extended impact region D1. In hydrogen-oxygen flame process this directing effect may be accomplished by another flame instead of a passive blower. Temperature control of blower 300 is important in processes where surface processes within the extended impact region D1 are driven by thermophoresis.

Also in this embodiment the far end of the extended impact region D1 may be equipped with deflecting means that deflect the particle flow away from the treated surface, as shown in FIG. 2. It is obvious for a person skilled in the art that the arrangement shown in FIG. 3 applies to circularly symmetric particle flows, as well as to elongated particle flows and to linear flame arrangements. Furthermore, FIG. 3 shows a configuration where the initial direction is vertical, i.e. the nozzle is in 90 degrees angle in respect to the defined plane of the treated surface. It is equally possible to combine a blower 300 with the tilted mutual positioning of the nozzle and the conveyor system 200 of FIG. 2 such that the blower 300 participates in the particle flow direction by guiding the particle flow towards the treated surface. In one preferable arrangement the blower 300 is oriented according to particle flow within region D1 thus reducing shear stress in the upper portion of particle flow. As a consequence, region D1 may be elongated considerably because flow velocity of particle stream is not lost by shear in communication with surrounding atmosphere.

Figure 4:
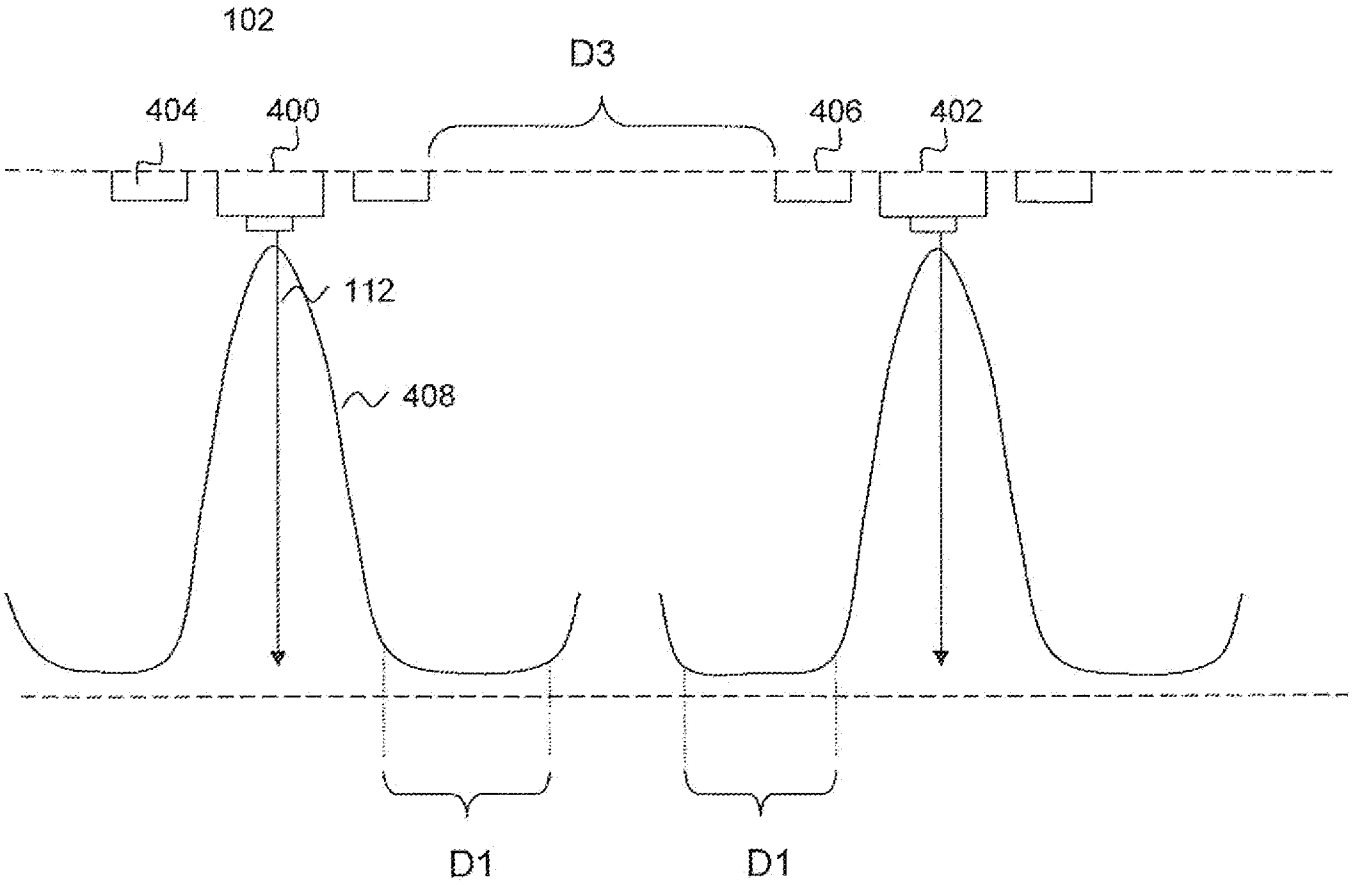
FIG. 4 illustrates another implementation of deflection means for a surface treating device.

FIG. 4 illustrates a further embodiment for the deflection means where particle flow is separated from the treated surface after the extended impact region D1 by another particle flow. Surface treatment of a large planar object may require use of a linear burner that comprises a number of nozzles 400, 402 arranged in line such that the distance D3 from one nozzle 400 to another nozzle 402 is fixed. The nozzles 400, 402 are complemented with flow control means 404, 406 that direct the particle flows 408, 410 to progress in the extended impact region D1 along the treated surface. Deflection of the particle flows from the treated surface is implemented here by adjusting the distance between the nozzles 400, 402 such that after travelling through the extended impact region D1 the particle flows from neighbouring nozzles collide, which directs the particle flows away from surface. The extended impact regions D1 allow surface treatment of large planar objects with a reduced number of nozzles. In addition, the required deflection at the end of the extended impact region can be implemented without need for separate elements. This configuration can be further enhanced by using nozzle elements that provide a flat flame pattern instead of a round one. Then it is possible to arrange the nozzles such that the flame tails partially overlap across region of collision as defined by the distance D3. This improves deposition uniformity under the collision region.

Figure 5:
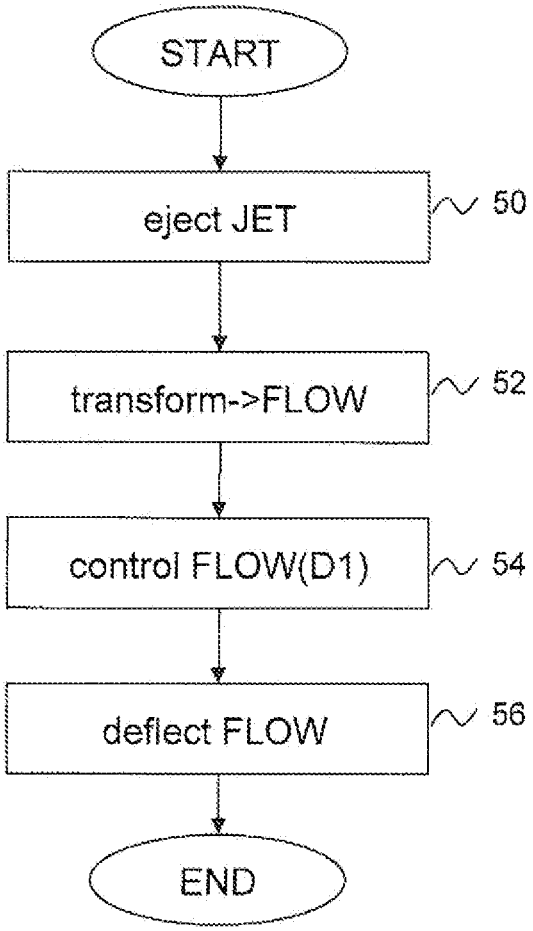
FIG. 5 illustrates an embodiment of a surface treatment method.

FIG. 5 illustrates a surface treating method applicable in the device of FIG. 2. Complementary details for the description of the method may thus be referred from FIGS. 1 to 4. The method begins in a stage where the device is turned on and operative for surface treatment. During operation the device ejects (step 50) from a nozzle a jet of droplets of liquid mixture (JET). Advantageously the jet of droplets is ejected as an aerosol spray where an applied gas (e.g. atomizer gas or some other gas added for the subsequent stages) acts as a carrier medium that delivers the jet of spray to a selected initial direction. The jet of droplets is exposed to a thermal reactor that transforms (step 52) the jet of droplets into a directed particle flow, the direction of the particle flow (FLOW) corresponding to the initial direction of the jet of droplets.

During operation the device incorporates a planar object (OBJ), the surface of which is to be treated. The device conveys the planar object through the particle flow such that the particles adhere to the surface of the planar object and implement the desired surface treatment thereto. The device may support or fix the planar object to a defined plane, and move the planar object through the particle flow. The device may, alternatively, comprise a mechanism for moving the nozzle in respect of the planar object.

When the planar object is delivered through the particle flow, the particle flow is controlled (step 54) by directing it to progress into an extended impact region D1 along the treated surface. As described with FIGS. 1 to 4, the nozzle and the conveyor element may, for example, be mutually positioned such that an impact region of the particle flow on the planar object includes an extended impact region where the particle flow progresses substantially along the surface of the planar object. The extended impact region may be implemented, for example, by positioning the opening of the nozzle such that the direction of the particle flow hits the surface of the supported planar object in an angle α that varies between 1 to 90 degrees. Alternatively, the extended impact region may be implemented, or enhanced, by exposing the particle flow to a stream of gas that pushes the particles towards the surface of the planar object. Extension of the impact region may include vortex flow formation to accumulate particles and heat as necessary for the efficiency of deposition process.

At a defined distance from the beginning of the impact region the particle flow is deflected (step 56) from the surface of the planar object such that any adverse effects from cooled parts of the particle flow are avoided.

By means of the embodied device and method the exposure of the particle flow with the treated surface is extended and the probability of the desired surface effects to occur is significantly increased. This reduces waste and makes the process more economical. It will be obvious to a person skilled in the art that, as technology advances, the inventive concept can be implemented in various ways. The invention and its embodiments are not limited to the examples described above but may vary within the scope of the claims.

The invention claimed is:

1. A surface treatment device that comprises:

a source element for ejecting a combination of precursor substances as a directed flow of surface treatment particles toward a region of direct impact;

a conveyor element for conveying planar objects along a defined plane through the particle flow;

directing means for controllably extending the particle flow to travel along a surface of the planar object beyond the region of direct impact to a region of extended impact; and flow control means for limiting the extent of the travel of the particle flow along the surface of the planar object outside the region of extended impact.

2. A surface treatment device according to claim 1, wherein the region of direct impact is a region on the surface of the planar object that the particle flow hits substantially in a direction of its average velocity during operation.

3. A surface treatment device according to claim 1, wherein the source element is configured to eject a liquid mixture, and the source element comprises a nozzle for outputting the liquid mixture as a jet of droplets.

4. A surface treatment device according to claim 1 wherein the source element comprises a thermal reactor for transforming the combination of precursor substances into a directed particle flow.

5. A surface treatment device according to claim 1, wherein the direction of the particle flow is configured to correspond to the direction of the average velocity vector of the particle flow.

6. A surface treatment device according to claim 1, wherein an angle between the direction of the particle flow and the defined plane is configured to be substantially 90 degrees.

7. A surface treatment device according to claim 1, wherein an angle between the direction of the particle flow and the defined plane is in the range of 1 to 90 degrees.

8. A surface treatment device according to claim 1, wherein the flow control means comprise deflecting means for deflecting the particle flow from the surface of the planar object outside the extended impact region.

9. A surface treatment device according to claim 8, wherein the deflecting means are configured to deflect the particle flow from the surface of the planar object before a region where natural separation would occur.

10. A surface treatment device according to claim 1, wherein the directing means comprise blowing means for blowing inert gas towards the particle flow travelling along the treated surface.

11. A surface treatment device according to claim 1, further comprising two or more nozzles, the distance between the nozzles, or rows of nozzles, being adjusted such that particle flows of neighbouring nozzles or rows of nozzles collide.

12. A surface treatment method, comprising:

ejecting a combination of precursor substances as a directed flow of surface treatment particles;

conveying planar objects along a defined plane through the particle flow;

directing the particle flow to travel along a surface of at least one of the planar objects to a first region; and controlling the extent of the travel of the particle flow away from the surface of the planar object in a region of natural separation outside the first region.

13. A method according to claim 12, further comprising transforming the combination of precursor substances into a directed particle flow in a thermal reactor.

14. A method according to claim 12, wherein the direction of the particle flow corresponds to a direction of the average velocity vector of the particle flow.

15. A method according to claim 12, wherein an angle between the direction of the particle flow and the defined plane is substantially 90 degrees.

16. A method according to claim 12, wherein an angle between the direction of the particle flow and the defined plane varies in the range of 1 to 90 degrees.

17. A method according to claim 12, wherein controlling the extent of the travel of the particle flow away from the surface of the planar object in a region of natural separation outside the first region comprises deflecting the particle flow from the surface of the planar object outside the extended impact region.

18. A method according to claim 12, wherein controlling the extent of travel of the particle flow away from the surface of the planar object in a region of natural separation outside the first region comprises deflecting the particle flow from the surface of the planar object before a region where natural deflection would Occur.

19. A method according to claim 12, further comprising blowing inert gas towards the particle flow travelling along the treated surface.

20. A method according to claim 12, wherein the combination of precursor substances is ejected from two or more nozzles, and further comprising adjusting the distance between the nozzles such that particle flows of neighbouring nozzles collide or overlap.

* * * * *